United States Patent [19]

Lohr

[11] 4,278,256

[45] Jul. 14, 1981

[54] TARGET GAME

[76] Inventor: Raymond J. Lohr, 5043 Sterrettania Rd., Erie, Pa. 16506

[21] Appl. No.: 65,565

[22] Filed: Aug. 10, 1979

[51] Int. Cl.[3] ..... A63F 9/02; F41J 9/00

[52] U.S. Cl. ..... 273/368; 124/27; 273/392; 273/405

[58] Field of Search ..... 273/355, 356, 368, 391, 273/392, 405; 124/26, 27

[56] References Cited

U.S. PATENT DOCUMENTS

| | | | |
|---|---|---|---|
| 659,555 | 10/1900 | Shuster | 46/116 X |
| 1,305,232 | 5/1919 | Niehage | 273/368 |
| 1,547,834 | 7/1925 | Smookler | 273/368 X |
| 1,650,935 | 11/1927 | Cox | 273/368 |
| 2,232,743 | 2/1941 | Swenson | 273/368 |
| 2,835,495 | 5/1958 | Lohr et al. | 273/356 |
| 2,905,468 | 9/1959 | Ellman | 273/368 X |

*Primary Examiner*—Anton O. Oechsle
*Attorney, Agent, or Firm*—Charles L. Lovercheck

[57] ABSTRACT

A target game comprising a gun and an enclosed target area attached to the muzzle end thereof having a series of moving knock-down targets which are resetable to an upright position, the projectiles are automatically returned to the firing mechanism, and the shots are recorded on a counting device.

11 Claims, 18 Drawing Figures

43
38
44
45

43
38
44
45

43
38
44
45
11
73
10

46
57
65
66
62

46
57
60
58
59

46
64
63
56
57
58
59
66
65
61
62
60
47
79
72

19
20
22
24
21
20
23
11
16
33
14
16
71
31
17
29
30

30
68
29
25
16
67
18
27
31
29
18
76
30
16

77
31
22
24
23
21
16
31
18
30
29

29
30
70
69
31

TARGET GAME

OBJECTS OF THE INVENTION

It is an object of the invention to provide an interesting target game which employs the skill of the player to hit moving targets with projectiles fired from a gun.

It is another object of the game to provide a target game with a multiplicity of moving targets which can be knocked from an upright to a down position by projectiles fired from the gun by the player.

It is another object of the invention to provide an enclosed target area to prevent loss of the projectiles after they are fired.

It is another object of the invention to provide targets which are automatically resetable from a down to an upright position to provide a relatively uninterrupted play with the device.

It is another object of the invention to provide a projectile return so that a relatively small number of projectiles can provide an unlimited number of shots.

It is another object of the invention to provide an improved firing mechanism which will provide a simple, reliable and accurate firing of the projectiles.

It is another object of the invention to provide a target game with a device to count each pull of the trigger, whereby the number of shots can be compared to the number of hits, thereby providing a competitive score.

It is another object of the invention to provide a target game which is simple in construction, economical to manufacture and simple and efficient to use.

GENERAL DESCRIPTION OF THE DRAWINGS

DETAILED DESCRIPTION OF THE DRAWINGS

Figure 1:
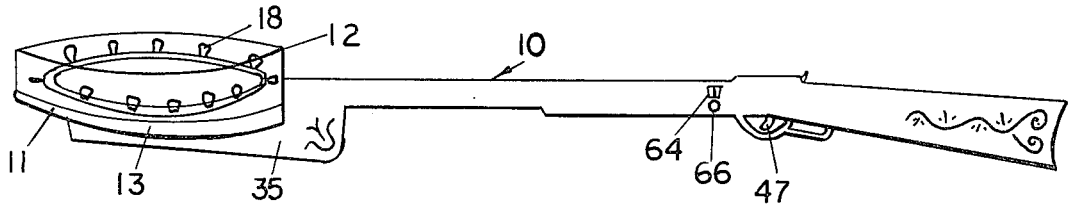
FIG. 1 is a view of the target game showing the gun and the enclosed target area.
Figure 2:
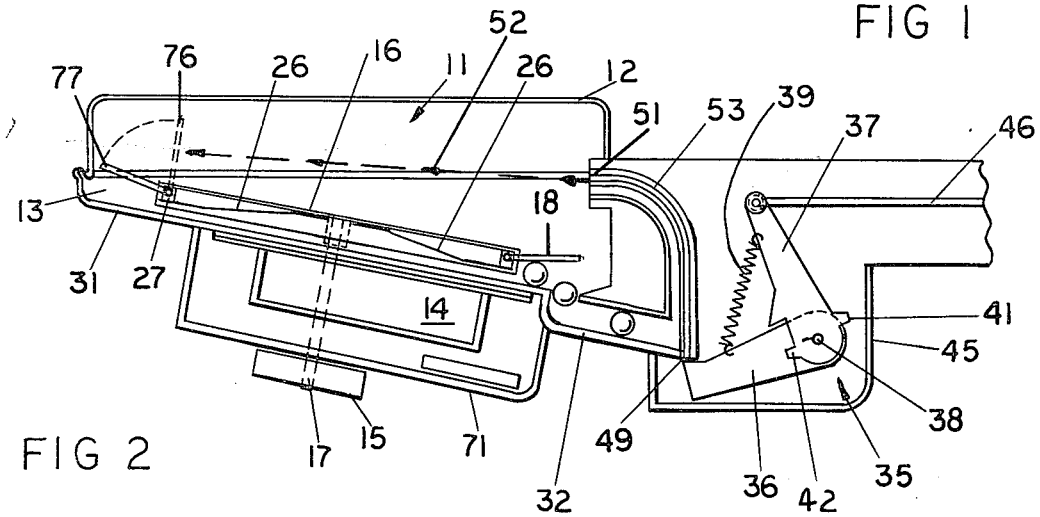
FIG. 2 is an enlarged cross-sectional view of the enclosed target area and the firing mechanism.
Figure 3:
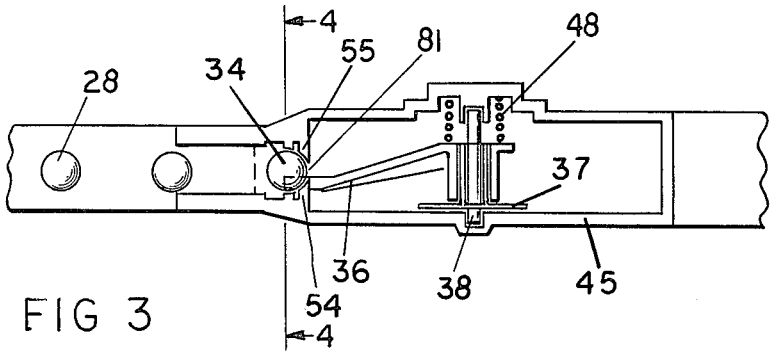
FIG. 3 is an enlarged cross-sectional top view of the firing mechanism.
Figure 4:
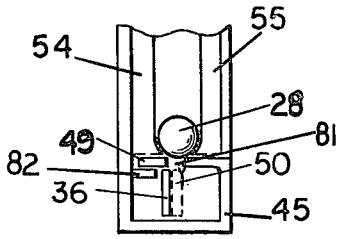
FIG. 4 is a view of the firing mechanism taken on Line 4—4 of FIG. 3.
Figure 5:
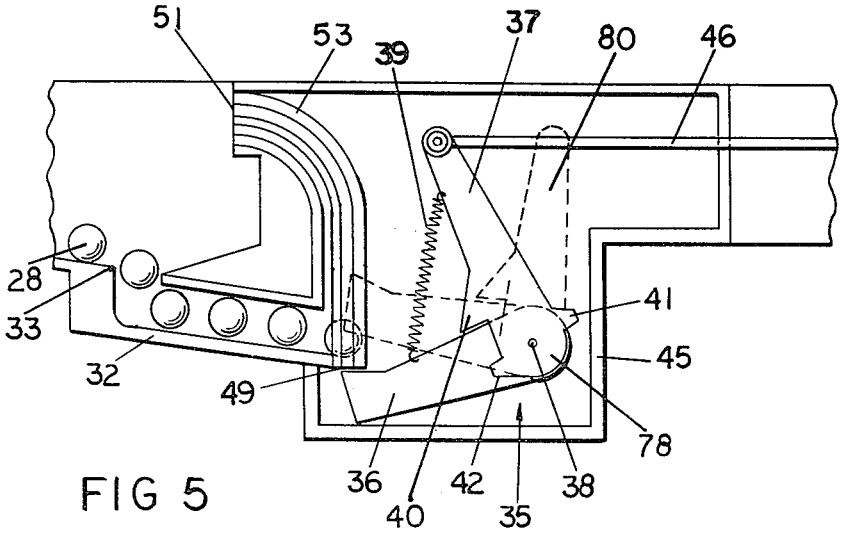
FIG. 5 is an enlarged cross-sectional side view of the firing mechanism.
Figure 6:
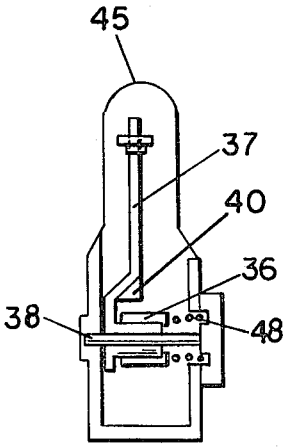
FIG. 6 is an enlarged rear view of the firing mechanism.
Figures 7, 8, 9, 10, 11, 12, 13, 14, 15, 16, 17, 18:
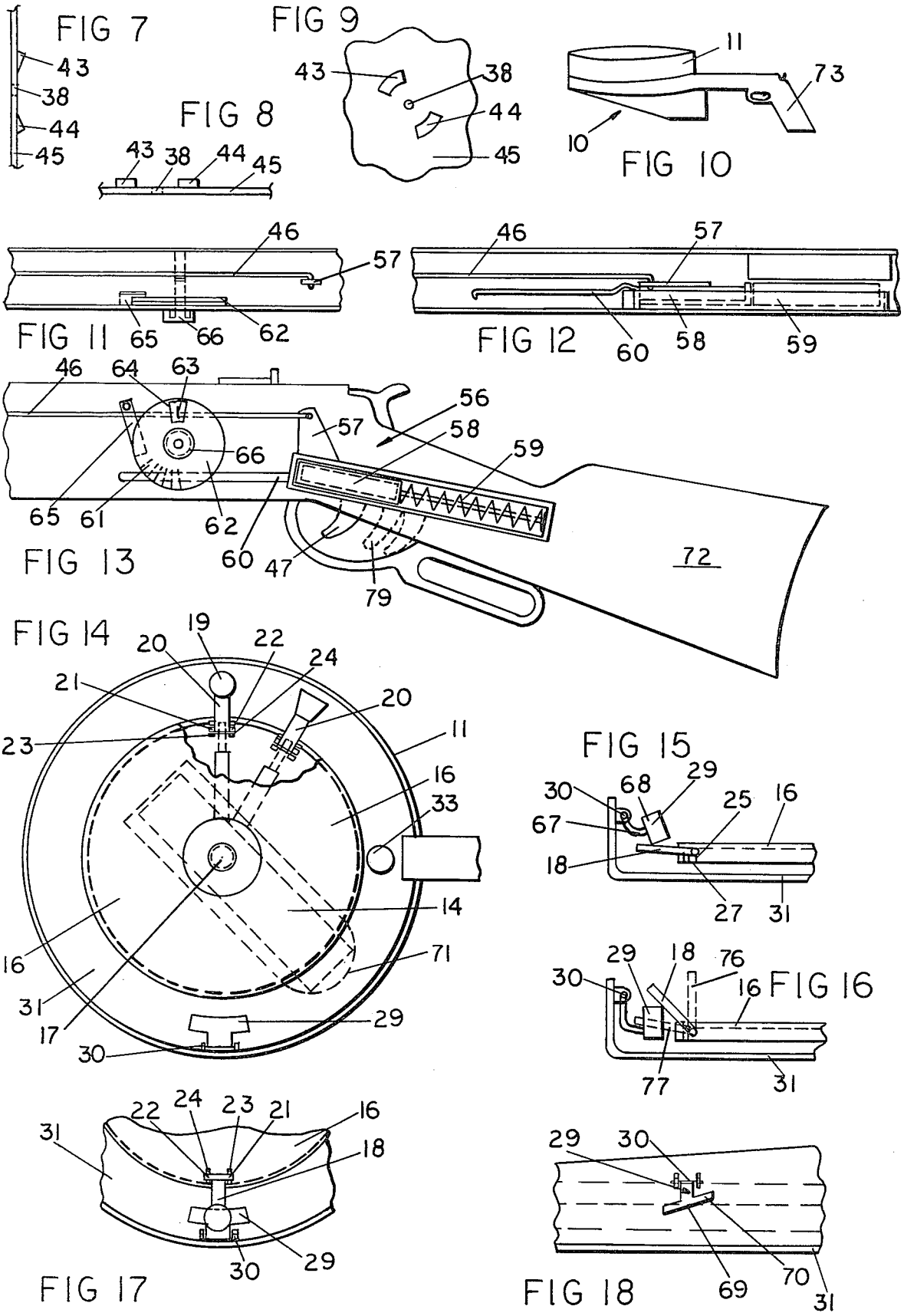
FIG. 7 is an enlarged end view of the firing cams.
FIG. 8 is an enlarged top view of the firing cams.
FIG. 9 is an enlarged side view of the firing cams.
FIG. 10 is a view of another embodiment of the invention.
FIG. 11 is a top view of the trigger and indicating mechanisms with some of the parts removed for clarity.
FIG. 12 is a top view of the trigger and indicating mechanisms with some of the parts removed for clarity.
FIG. 13 is a side view of the rifle showing the trigger and indicating mechanisms.
FIG. 14 is a top view of the target area.
FIG. 15 is a side view of the reset cam shown passing over a target in the down position.
FIG. 16 is a side view of the reset cam shown lifting a target to the up position.
FIG. 17 is a top view of the reset cam shown with a target being lifted to the up position.
FIG. 18 is an end view of the reset cam.

A target game 10 made of sturdy plastic or other suitable material having a target area 11 enclosed on its top and sides by a cover 12 made of clear plastic or other transparent material and across its bottom by a target base 13. The target game 10 may be made in the form of a rifle 72 and used by holding the rifle up to the shoulder and sighting along the horizontal barrel in the conventional manner of firing a rifle. The game may also be made in the form of a pistol 73 in which case, in addition to holding the pistol in the conventional manner, the target may be placed on a table or other horizontal surface to hold it level and be fired from this position.

The target base 13 has affixed to its underside the clockspring motor 14 which has a winding key 15 projecting through the motor case 71. The target can also be powered by an electric motor and battery located in the motor case 71.

The targets 18 are mounted on a platform 16 which is adapted to be rotated by the clockspring motor 14 by axle 17. Each target 18 has an impact area 19 which may be round or in the shape of an animal or a bird, for example. Each target has a support member 20 having at its lower end projections 21 and 22 which protrude into recesses in brackets 23 and 24 and hold the target rotatably in position. The lower end of the support member 20 has flat bottom surface 25 on which the target rests when the target is held in an upright position by flat spring 26. The support member 20 has a flat rear surface 27 which rests against flat spring 26 when the target is in the down position. Thus, the flat spring 26 assures that the targets will be maintained in either an up position 76 or a down position 77. The targets 18, when impacted by a projectile 28, will be moved from an up position 76 to a down position 77.

A reset cam 29 is affixed to the target base 13 adjacent the perimeter of the target base 13. While the motor 14 is running, the targets 18 on the platform 16 will be turned in a clockwise direction and targets which have been impacted by projectiles and knocked down to the down position 77 will move through the position of the reset cam. The target 18 in the down position 77 will engage the bottom surface 69 of the reset cam as it moves past. The reset cam will move upwardly out of the path of the target by turning on hinge 30 as the target pushes against the cam. When winding the spring to recharge the motor, the target base will turn in a counterclockwise direction and the targets will engage the reset cam on its upper surface 70. As the targets move past the inclined upper surface of the cam, the targets will be raised from their down position 77 where they were restrained by the spring 26 to a point where the spring 26 will snap the targets to their up position 76 by pushing against the bottom surface 25.

The target area floor 31 is inclined at an angle of approximately 10 degrees with respect to the gun barrel when the gun is held in a firing position. The projectiles 28 which may be round steel balls will, after impacting a target or the target area cover, return under the influence of gravity to a lower ball race 32 whose first end 33 is located at a low point in the inclined target area floor 31.

The connecting rod 46 which is connected as its forward end to the trigger lever 37 and extends the length of the barrel of the gun into the area of the trigger mechanism 56 where it is attached to the bracket 56, which is attached to the slider 58. The trigger 47 is attached to the lower side of the slider 58. When the trigger is engaged by the finger and moved rearwardly compressing a spring 59, the connecting rod is moved rearwardly moving the trigger lever 37 into the firing position 80 and the spring finger 60 also attached to the slider 58 is moved rearwardly as the trigger is moved rearwardly. The spring finger 60 engages a ratchet 61 as it moves rearwardly turning the dial 62 through a predetermined distance so that the indicia 63 visible at the indicator 64 will indicate an incremental increase with each pull on the trigger. A spring detent 65 is provided to prevent the dial from slipping backwards. A knob 66 attached to the dial 62 is used to return the score to zero between games.

The reset cam 29 is swingably attached to the target base 13 by the hinge 30. The reset cam is comprised of a stem 67 which has the hinge 30 at its upper end and an inclined cam 68 at its lower end. The stem 67 extends downwardly and inwardly and terminates in the cam 68. The cam 68 projects into the path of the targets 18 when they are in their down position 77. As the targets move past in a clockwise direction while the game is in progress, the targets approach the cam at its high end. The targets contact the cam on its under side and as the targets move past the position of the reset cam 29, the reset cam is swung upwardly by the target 18 on the hinge 30. At the conclusion of the game, when the motor 14 is rewound, the targets 18 are moved in a clockwise direction. The targets engage the upper side 70 of the cam 68. As the targets move past the reset cam 29, the targets are swung upwardly, rotated on their projections 21 and 22, to a point where the flat spring 26 will snap the target upright and come to rest against the flat bottom surface 25 of the target.

The lower ball race 32 comprises a passageway inclining downwardly to move the projectile by gravity into a firing position 34 where the projectile 28 is engaged by the impulse mechanism 35.

The impulse mechanism is made up of an impulse lever 36 and a trigger lever 37 which rotate about axle 38. A tension spring 39 is attached at one end to the impulse lever 36 and is attached at its other end to the trigger lever 37. A tension is maintained on the tension spring 39 by stop 40 on trigger lever 37 which engages impulse lever 36. The stop 40 limits the distance that the spring 39 can pull the impulse lever 36 when the impulse lever is not restrained by pad 49. The trigger lever 37 at its end attached to axle 38 has two arms 41 and 42. Arms 41 and 42 ride up on two cams 43 and 44 which are molded into the frame of the impulse mechanism cover 45.

When the trigger 47 is pulled by the player the connecting rod 46 moves the trigger lever 37 rearwardly. The arms 41 and 42 on the end of the trigger lever are rotated about the axle 38 and ride up on the cams 43 and 44. The trigger lever and impulse lever are held against the impulse mechanism cover 45 by the compression spring 48. As the arms 41 and 42 ride up on the cams 42 and 43 the levers move away from the impulse mechanism cover 45 further compressing the spring 48. When the trigger 47 is moved to a firing position 79 which is a position short of the maximum movement of the trigger the connecting rod 46 has moved the trigger lever 37 rearwardly to a firing position 80 at a point short of its maximum movement, at which point the arms on the lever 37 and the cams on the cover 45 will have pushed the impulse lever 36 to a firing position 50 at a point where it is no longer restrained from upward movement by the pad 49 and the impulse lever 36 will kick upwardly through the gap 81 under the force of the tension spring 39 imparting a velocity to a projectile 28 position in the firing position 34. The upward motion of the impulse lever 36 will be stopped when it engages the projection 40 on the trigger lever 37 when the trigger 47 is released a spring 59 returns the trigger to its original position and through the connecting rod 46 turns the trigger lever 57 back to its original position. The impulse lever 36 is rotated downwardly by the stop 40 until it is through the gap 81. When the impulse lever is below the pad 49 the compression spring will push the lever against the cover 45, and the mechanism is reset for the next shot.

The lower ball race 32 narrows to a diameter just larger than the projectile 28 at the firing position 34. From the firing position 34, the upper ball race 53 extends upwardly and curves forwardly terminating at its second end 51 so as to direct the projectile 28 along the desired trajectory 52 into the target area 11.

The upper ball race 53 is made up of two spaced curved ribs 54 and 55. The space between the ribs 54 and 55 forces the projectile which should be in the form of a sphere to center itself as it moves upwardly and outwardly along the ribs. By being so centered, the projectory 52 of the projectile 28 is predictable and accurate and therefore makes the shooting and knocking down of the targets 18 a matter of skill and therefore an interesting and challenging game as opposed to a matter of luck.

The target game herein offers all of the play value of a free swinging gun, that is a hand-hald, hand-carried toy, being completely self-contained and having a target area rigidly attached to the muzzle of the gun. The player gets the enjoyment of seeing bullets fired from the muzzle in flight and knocking down targets. The miniature targets close to the gun give the effect of distant targets as the child sights down the barrel. The moving targets and the self-loading bullets, along with the shot recording feature for competitive scoring add interest to the game.

The foreging specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A target game (10) comprising, a toy gun (72,73) adapted to be held in the hand and carried about a play area in use, an enclosed target area (11) rigidly attached to said gun adjacent the muzzle thereof and extending forwardly therefrom, targets (18) supported in said target area, means for moving said targets, means for firing supported in said gun, projectiles, said firing means being adapted to impart velocities to the projectiles and to direct said projectiles into the target area, said targets being moved through the path of the directed projectiles at a point in the target area opposite the point of attachment of the target area to the gun.

2. The target game disclosed in claim 1 wherein said moving means comprises a platform (16) having the targets (18) supported thereon, an axle (17) supporting said platform (16) in said target area (11) at an angle relative to a center line of the gun, said targets nearest the gun being spaced below the path of said directed projectiles, said targets furthest from the gun being supported in the path of the directed projectiles, said axle operatively connected to a motor (14), said motor (14) being supported by a base (31), said base (31) forming the bottom of said enclosed target area (11).

3. The target game disclosed in claim 1 wherein said firing means (35) comprises, a first lever (37) and a second lever (36) rotatably supported on a second axle (38), a first spring (39) having a first end and a second end, said first end being attached to said first lever (37) and said second end being attached to said second lever (36), said first spring (39) being under tension, connecting means (46) connecting said first lever (37) to a trigger (47), a stop on said gun, said second lever (36) engaging said stop, said first lever (37) having cam engaging arms (41, 42), cams (43, 44) being disposed on the inner surface of said gun adapted to engage said arms (41, 42), said trigger (47) turns said first lever (37) moving said arms (41, 42) into engagement with said cams (43, 44), a second spring (48) disposed around said second axle (38) is compressed when said arms (41, 42) engage said cams (43, 44), said cams (43, 44) being adapted to move said first lever (37) and second lever (36) sideways on said axle (38) when said arms engage said cams, said second lever (36) being adapted to be moved to a gap (81) in said stop (49) whereby said second lever (36) is urged upwardly by said first spring (39) imparting an impulse to a projectile (28) located in a firing position (50), a stop on said first lever, said second lever engages the stop on said first lever.

4. The target game described in claim 1 wherein said base (31) is inclined downwardly toward the gun at an angle sufficient that a projectile (28) will move by gravity to an aperture located at a low point in said base of said target area whereby said projectiles are automatically gathered.

5. The target game described in claim 1 wherein a lower ball race extends between a low point in the target area and a firing position thereby providing a path for the projectile, an upper ball race extending upwardly and forwardly from the firing position comprising two upwardly curving spaced ribs whereby the projectiles are guided upwardly and outwardly into the target area.

6. The target game disclosed in claim 1 wherein said targets (18) are moveably attached to a platform (16), the targets (18) having a flat bottom surface (25) and a flat rear surface (27) at their lower ends, a flat spring (26) being supported by the platform (16) rests against the lower ends of the target (18), the targets (18) are held in an up position when the spring rests against the flat bottom surface and the targets are held in a down position when the flat spring rests against the flat rear surface.

7. The target game disclosed in claim 1 wherein a reset cam (29) is provided moveably supported on a side of said target area, said reset cam having an inclined surface projecting into the path of the targets (18) when said targets are in the down position, the targets being adapted to move in a first direction and engage the under side of said reset cam, pushing the cam up out of the way as the targets move past, targets being adapted to engage the upper surface of the inclined cam as they move in a second direction, the targets are pushed upwardly to a point where a flat spring will engage a flat bottom surface of the target holding said target rigidly in position.

8. The target game recited in claim 1 wherein a trigger is provided having a spring attached to return the trigger to an initial position, a bracket receiving a rod connected to the firing mechanism, whereby when the trigger is pulled the connecting rod moves the firing mechanism to a firing position and after the pressure is released from the trigger, the spring returns the trigger to an initial position.

9. The target game disclosed in claim 1 wherein a counting device comprising a dial mounted on the frame of the gun having ratchets on its rear surface and indicia on its front surface, a finger attached to a slider on said trigger, said finger engages said ratchets on said dial, each pull of the trigger advances the dial one space, whereby the counter will show an incremental increase with each pull of the trigger.

10. The target game disclosed in claim 1 wherein said moving means comprises a platform moveably supported in the target area having targets supported thereon, a motor being operatively connected to said platform, said motor being attached to said target area.

11. The target game disclosed in claim 1 wherein said moving means comprises a platform moveably supported in the target area having targets supported thereon, a motor being operatively connected to said target area, said motor being attached to said platform.

* * * * *